US006983716B1

(12) United States Patent
Ankney et al.

(10) Patent No.: US 6,983,716 B1
(45) Date of Patent: Jan. 10, 2006

(54) AUTOMATIC BIMINI TOP

(76) Inventors: Terence Dean Ankney, 6385 Buffalo Dr., Nineveh, IN (US) 46164; Douglas J. Rodgers, 2355 W. 236th St., Sheridan, IN (US) 46069

( * ) Notice: Subject to any disclaimer, the term of this patent is extended or adjusted under 35 U.S.C. 154(b) by 16 days.

(21) Appl. No.: 11/042,431

(22) Filed: Jan. 25, 2005

(51) Int. Cl.
*B63B 17/00* (2006.01)

(52) U.S. Cl. ..... 114/361

(58) Field of Classification Search ..... 114/343, 114/361

See application file for complete search history.

(56) References Cited

U.S. PATENT DOCUMENTS 2,821,989 A * 2/1958 Shepard ..... 114/361
4,091,484 A 5/1978 Means
5,303,667 A * 4/1994 Zirkelbach et al. ..... 114/361
5,520,139 A * 5/1996 King et al. ..... 114/361
5,706,752 A 1/1998 Menne
5,803,104 A 9/1998 Pollen
6,209,477 B1 4/2001 Biedenweig
6,260,505 B1 7/2001 Polidan
6,672,241 B2 1/2004 Warfel

* cited by examiner

*Primary Examiner*—Lars A. Olson
(74) *Attorney, Agent, or Firm*—Frank D Lachenmaier

(57) ABSTRACT

This invention generally relates to convertible tops for boats. More specifically, this invention relates to a remotely operated, automatic lift system for Bimini tops for water craft that moves the top from its down or travel position all the way to its fully extended open or up position and back down with an intermediate stop at the Radar position optional.

5 Claims, 6 Drawing Sheets

AUTOMATIC BIMINI TOP

BACKGROUND

Field of Invention

This invention generally relates to convertible tops for boats. More specifically, this invention relates to a remotely operated, automatic lift system for Bimini tops for water craft that moves the top from its down or travel position all the way to fully extended open or up position and back down with an intermediate stop at the Radar position optional.

PRIOR ART

U.S. Pat. No. 4,091,484 Means 1978 discloses a collapsible boat canopy with stowage beneath a lift-up seat (not powered). U.S. Pat. No. 5,706,752 Menne 1998 shows a Bimini sun top for a pontoon boat including square aluminum tubes and extruded aluminum fittings securing the top frame to the boat side rails (not powered). U.S. Pat. No. 5,803,104 Pollen 1998 shows a frame system for a Bimini cover for a watercraft deck (not powered). U.S. Pat. No. 6,260,505 Polidan 2001 demonstrates a pontoon boat cover system with an aluminum frame that has pivot brackets that snap onto frame rails. U.S. Pat. No. 6,672,241 Warfel 2004 shows a foldable frame for a boat cover that has latching members which latch the collapsed frame members together and to the boat for travel. Finally U.S. Pat. No. 6,209,477 Biedenwig 2001 does show a powered retractable Bimini top, but it only moves between a horizontal travel or bridge clearing attitude and the Radar position (leaning backward at approximately a 60 degree angle). It can have either a center lift strut or two outboard edge struts and can be driven by either electric motor or motors or other unspecified means.

Means, Menne, Pollen, Polidan and Warfel Utility Patents all are directed at manually operated, collapsible boat top frames and the way they fasten to the boat, lift, latch and travel not the powered system as will be described in the following specification. Biedenwig is the only collapsible boat top system that shows a powered lift and lower assist and it only provides that assist from the horizontal position close to the deck to the radar position.

The Bimini type of top is frequently used on pontoon or deck boats which are often used by boaters with diminished dexterity. For many older boaters raising the top from the Radar position to the fully upright position is a more difficult task than they can handle. Modern consumers are expecting that more of their previously manual tasks will be automated and this invention satisfies that expectation by providing a quick and simple automated convertible boat top lift.

SUMMARY

The Automatic Bimini Top will raise automatically from the DOWN (horizontal travel) position all the way to the fully OPEN position without a manual stage from the RADAR (angling upward and aft at approximately a sixty degree angle) position and return it to the RADAR or DOWN position by toggling a switch at the helm.

In a preferred embodiment the frame is comprised of a rear bar, a front bar and two short bars made from square, round or rectangular aluminum tubes that are formed into u-shaped boat width supports for a typical Bimini top. The front bar is pivotally mounted on the rear bar behind the pivotal attachment point where the rear bar is connected to the side rails of a boat and pivotally attached midway up these bars are shorter support bars which are pulled open by the unfolding of the top, supporting the middle of the top.

The Automatic Bimini Top apparatus has automatic lift and lower capabilities such that the top can be raised and lowered completely without a manual intervention, utilizing a pneumatic, hydraulic or electromechanical system for the main lift and lower functions and utilizing springs between the short bars and the front and rear bars for the spring collapse assist function. In the preferred embodiment there are lift actuators on both sides of the boat which are pivotally mounted to the side rails of the boat, to raise the top from the DOWN position to the RADAR position. To complete the raising from the RADAR position, actuators attached to the curved end of the rear bar and pivotally mounted midway up the front bar, retract their actuator rods, again on both sides of the boat.

DRAWINGS

In order that the invention may be more fully understood it will now be described by way of example, with reference to the accompanying drawings in which FIG. 1 is a perspective view of the Automatic Bimini Top mounted on an illustrative pontoon boat in the up or OPEN position.

REFERENCE NUMERALS

Figure 1:
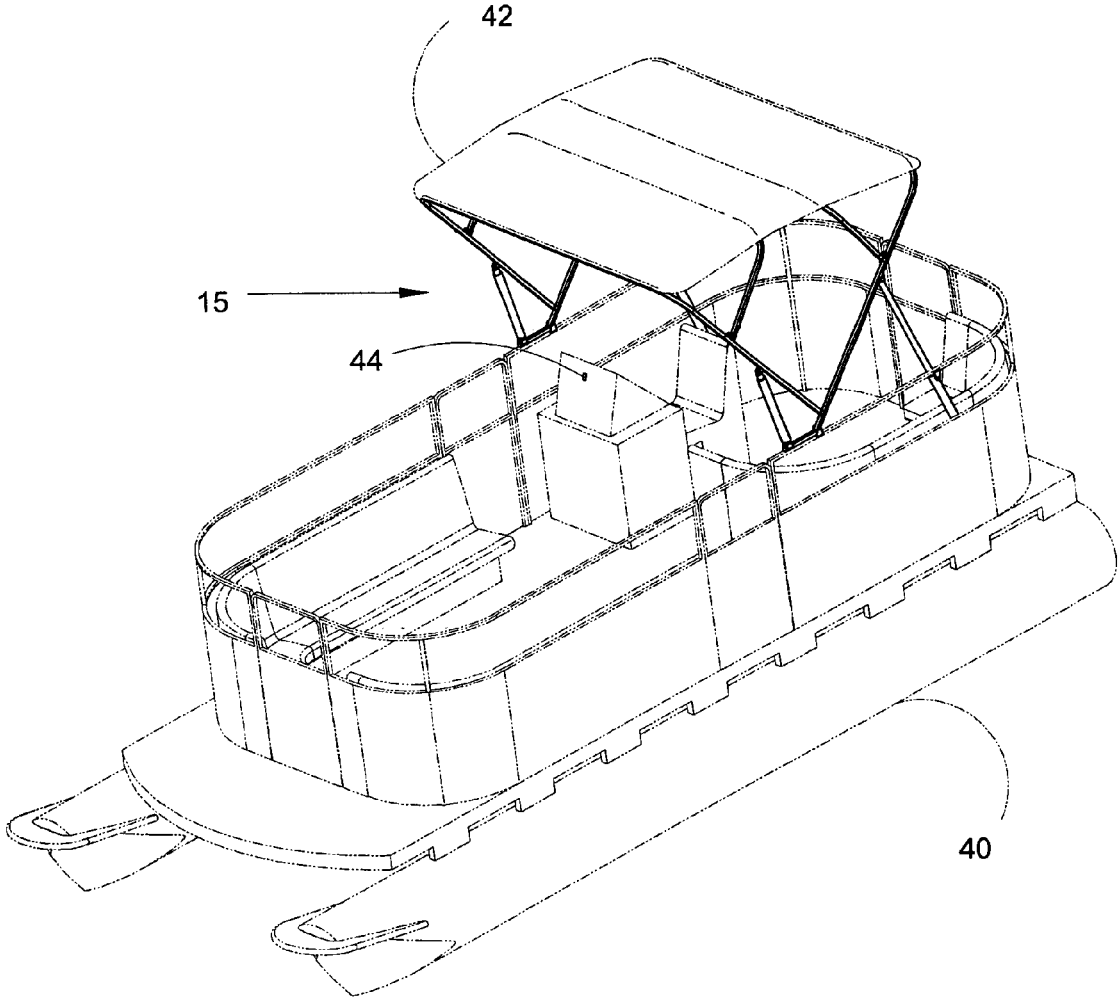

15—Automatic Bimini Top
16—front bar
18—front bar mid-pivot
20—front bar top pivot
22—front short bar
24—torsion assist spring
26—front actuator
28—front actuator bottom pivot
30—rear bar
32—rear short bar
34—front actuator rod
36—rear bar bottom pivot
38—front bar bottom pivot
40—typical pontoon boat
42—typical Bimini Top
44—toggle switch
46—rear front actuator rod
48—rear actuator
50—rear bar mid-pivot
52—rear bar top pivot
54—rear actuator floating pivot
56—pivot pin
58—travel boot

DETAILED DESCRIPTION

In order that the invention may be more fully understood, it will now be described by way of example with reference to the accompanying drawings which represent and illustrate Automatic Bimini Top 15. Automatic Bimini Top 15 can be utilized with pneumatic, hydraulic or electromechanical lift mechanisms. For illustrative purposes, a electro-mechanisal system with actuators and front actuator rods is shown in the drawings.

Figure 2:
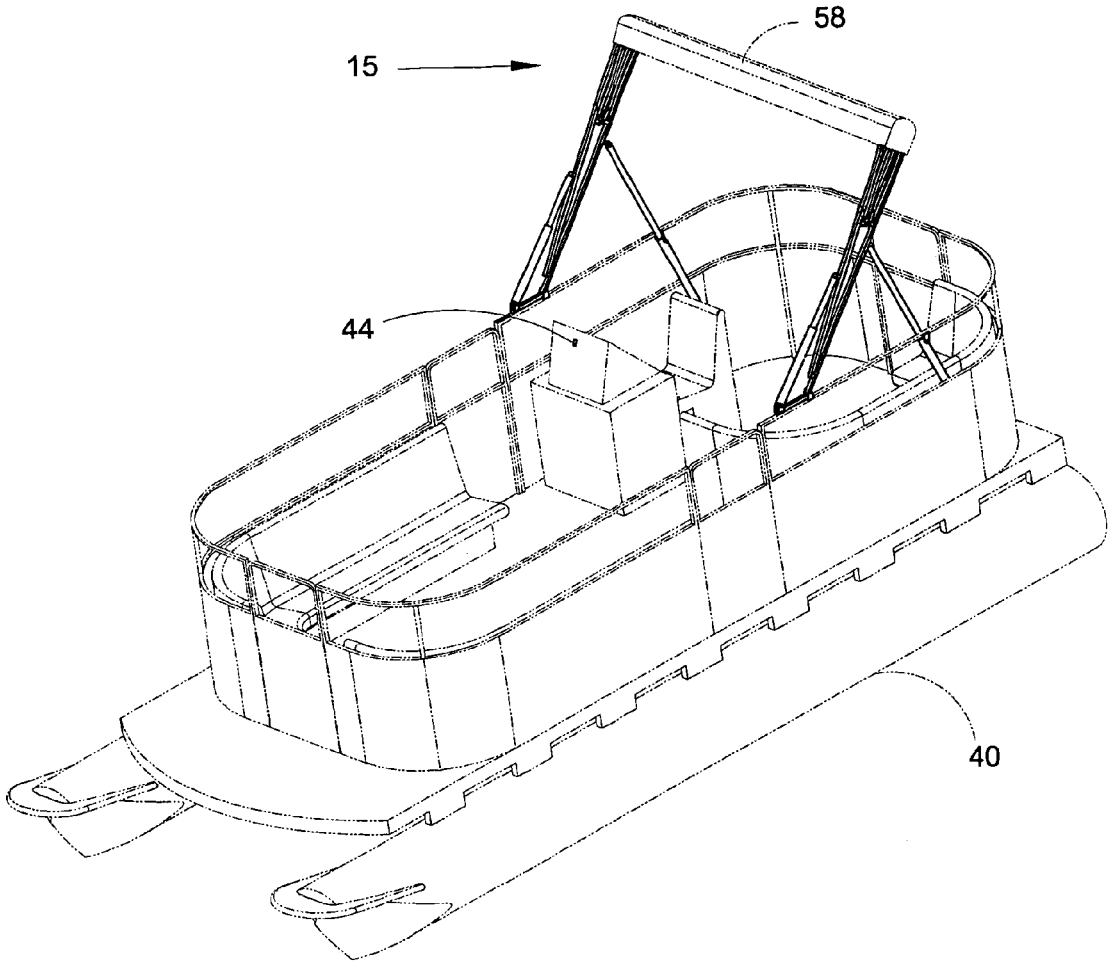
FIG. 2 is a perspective view of the Automatic Bimini Top mounted on an illustrative pontoon boat in the RADAR position with the illustrative top cased in an illustrative travel boot.
Figure 3:
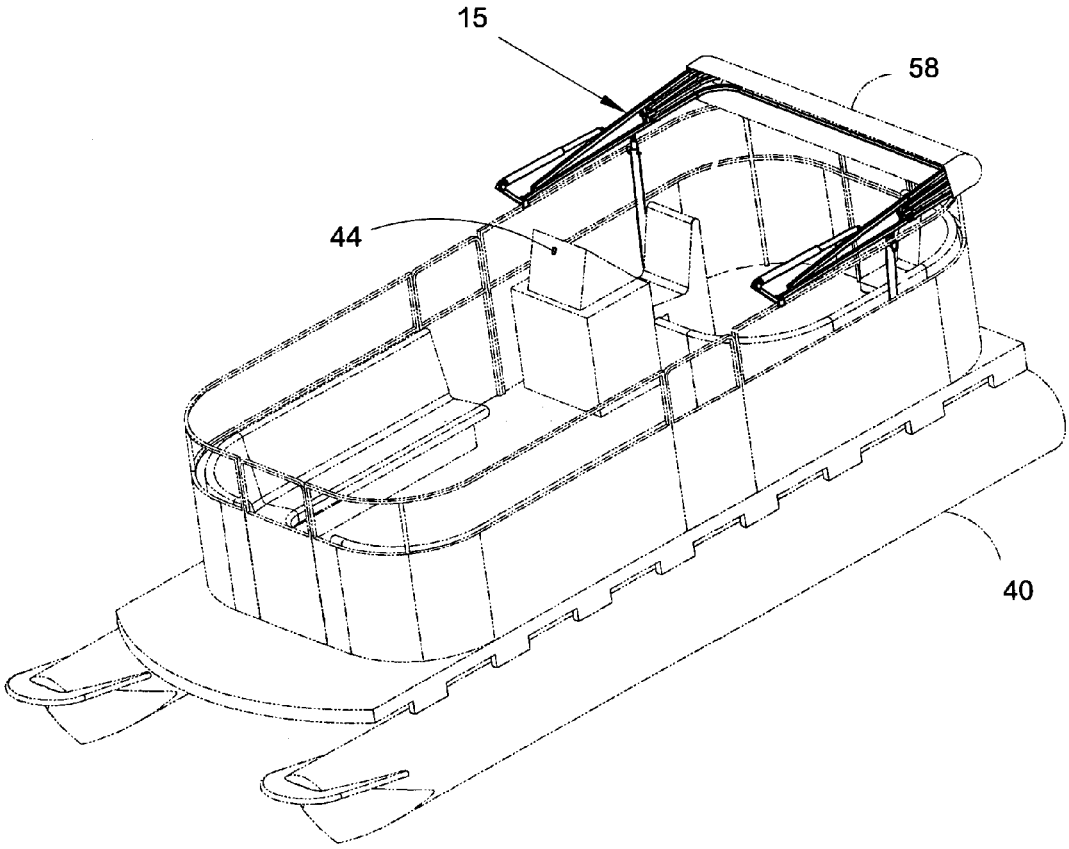
FIG. 3 is a perspective view of the Automatic Bimini Top mounted on an illustrative pontoon boat in the DOWN or travel position with the illustrative top cased in an illustrative travel boot.

Turning to FIG. 1, in a perspective view, Automatic Bimini Top 15 is shown in its OPEN position. Typical Bimini top 42 in its fully open position and typical pontoon boat 40 are shown in phantom lines for illustrative purposes and form no part of this claimed invention. Toggle switch 44 is shown in an approximate location but could be mounted in any convenient location. FIG. 2 shows Automatic Bimini Top 15 in its RADAR position and FIG. 3 shows Automatic Bimini Top 15 in its DOWN position, both in perspective views where top 42 is encased in travel boot 58, also shown in phantom lines and forming no part of this invention.

Figure 4:
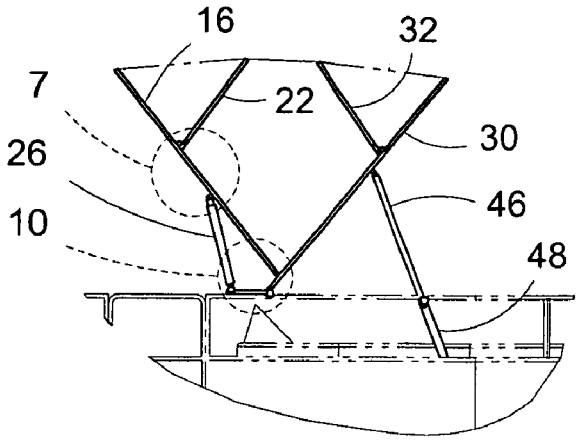
FIG. 4 is a side view of Automatic Bimini Top in the OPEN position.
Figure 5:
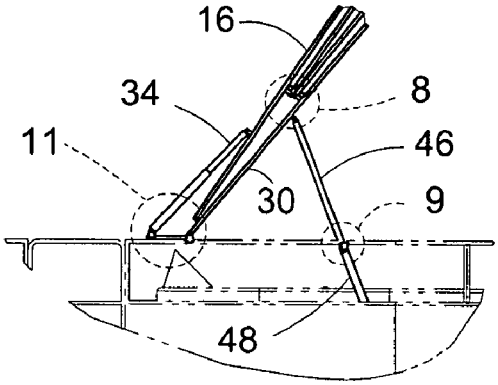
FIG. 5 is a side view of Automatic Bimini Top in the RADAR position.
Figure 6:
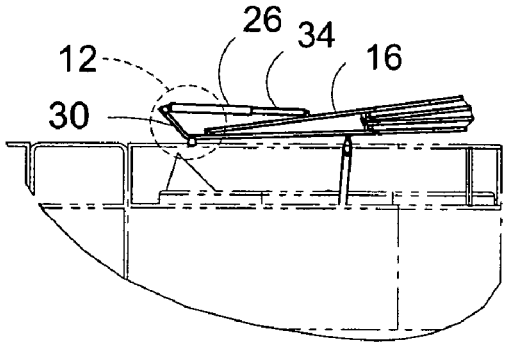
FIG. 6 is a side view of Automatic Bimini Top in the DOWN position.

FIGS. 4,5 and 6 show side views of Automatic Bimini Top 15 in the three above mentioned positions from the left side of typical pontoon boat 40. The right side views are mirror images of the left side views and both sides have a matching set of springs and lift mechanisms.

FIG. 4 shows expanded side views 7 and 10 in the OPEN position. It also discloses rear bar 30 with rear short bar 32 and front bar 16 pivotally attached to it with front short bar 22 pivotally connected to front bar 16. These boat width bars are formed from square, round or rectangular aluminum tubing and the u-shapes are deep enough to provide walk-under clearance when in the OPEN position. All of the pivot brackets are u-shaped aluminum devices with standing side-walls with sufficient space between them to slip fit the bars, the distal ends of the actuator rods and the proximal ends of the actuators that need to be pivotally attached. The side walls have aligned transverse holes that match with through holes in the bars or distal ends of the attaching shafts. These holes are sufficient in diameter to allow for insertion of conventional pivot pins 56. The brackets are mounted to the side rails of the watercraft or to the front and rear bars with conventional attachment techniques, such as screws. This view also shows the proximal end of front actuator 26 mounted to end of rear bar 30 and the distal end of rear actuator 48 pivotally attached to the side rail of a typical pontoon boat shown in phantom lines. Rear actuator rod 46 is shown in its fully extended state.

FIG. 5 shows expanded side views 8, 9 and 11 in the RADAR position. This view shows front actuator rod 34 extended which has forced Automatic Bimini Top 15 into its RADAR position.

FIG. 6 shows expanded side view 12 in the DOWN position where rear actuator rod 46 has retracted pulling the collapsed assembly down parallel with the deck of the boat.

Figure 7:
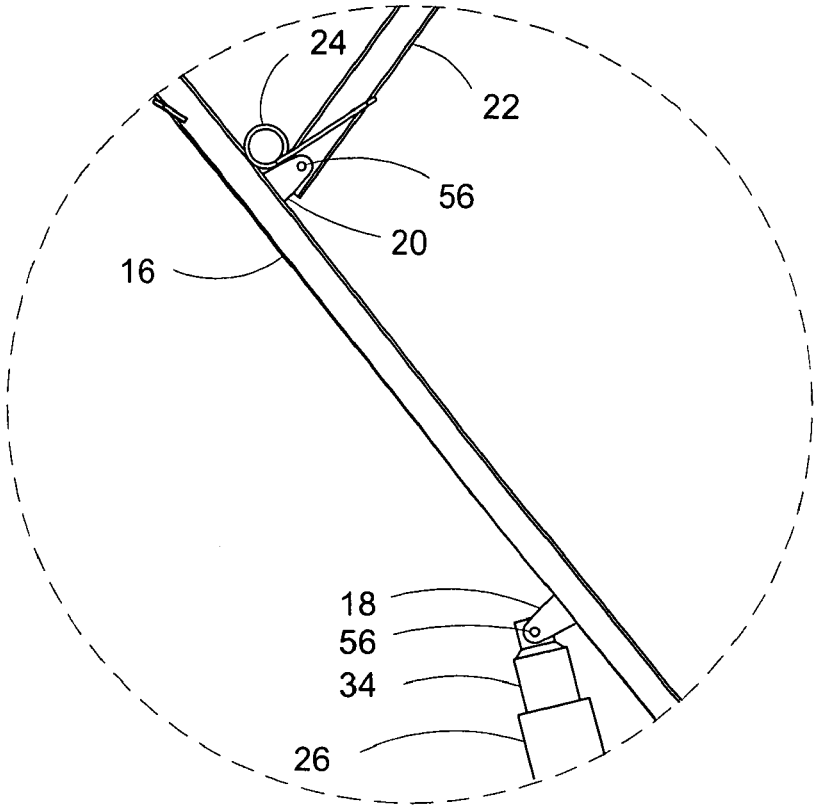
FIG. 7 is a partial expanded side view showing a torsion spring assist in tension in the OPEN position and front bar actuator mount.

FIG. 7 shows a 10× partial side view of torsion assist springs 24 under tension between front bar 16 and front short bar 22 pulling them radially together, pivoting about front bar top pivot 20 from the fully open position. Torsion assist springs 24 are shown here but any conventional compression, air or gas springs could be utilized. Front actuator rod 34 is shown retracting into front actuator 26 and pivotally attached to front bar 16 at front bar mid-pivot 18.

Figure 8:
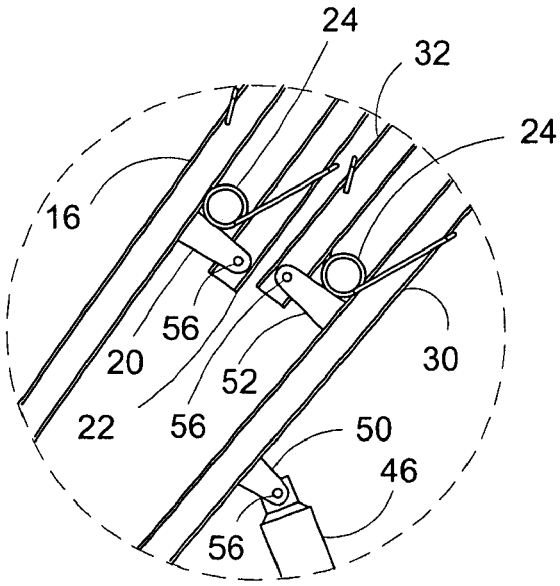
FIG. 8 is a partial expanded side view showing all four Bimini top support bars and their assist springs in the RADAR position along with the rear actuator mount.

FIG. 8 shows a 10× partial side view of bars 16, 22, 30 and 32 in their RADAR state with all four torsion assist springs 24 in their contracted state. This view also shows rear bar top pivot 52 which pivotally connects rear bar 30 and rear short bar 32 and rear piston 46 pivotally attached to rear bar 30 at rear bar mid-pivot 50.

Figure 9:
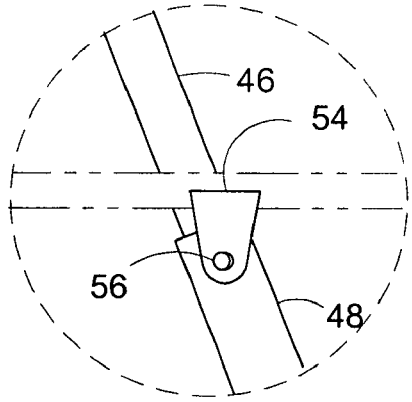
FIG. 9 is a partial expanded side view showing the rear actuator pivot mount to the side rail of an illustrative pontoon boat.

FIG. 9 shows the top of rear actuator 48 pivotally mounted to the side rail for typical pontoon boat 40 at rear actuator floating pivot 54. The proximal end of rear actuator 48 is allowed to swing freely as rear actuator rod 46 is retracted into rear actuator 48.

Figure 10:
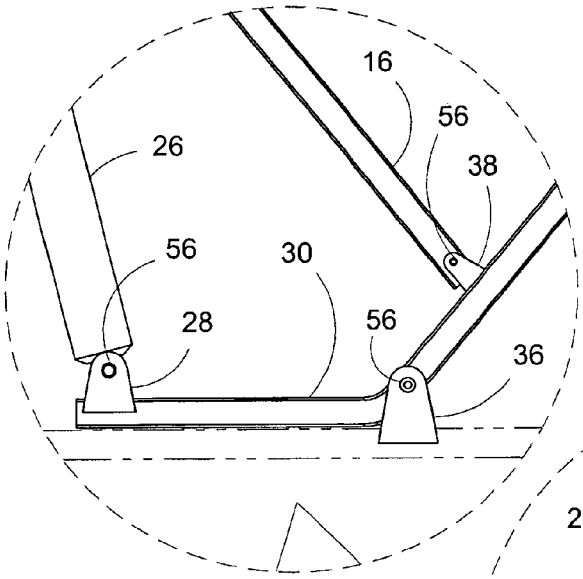
FIG. 10 is a partial expanded side view showing the attachment of the front and rear bars, the mounting of the front actuator to the rear bar and the pivotal mounting of the rear bar to the side rail of the illustrative pontoon boat when the top is in the OPEN position.
Figure 14:
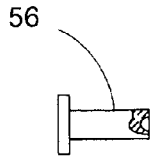
FIG. 14 is a side view of a pivot pin

FIG. 10 is a 10× partial side view showing the curve or bend in the bottom of rear bar 30 and how it is pivotally mounted to the side rail of typical pontoon boat 40 at rear bar bottom pivot 36 when Automatic Bimini Top 15 is in its OPEN position. It also shows front bar 16 pivotally mounted to rear bar 30 at front bar bottom pivot 38. This view also shows the pivotal mounting of front actuator 26 to the end of rear bar 30 at front actuator bottom pivot 28.

Figure 11:
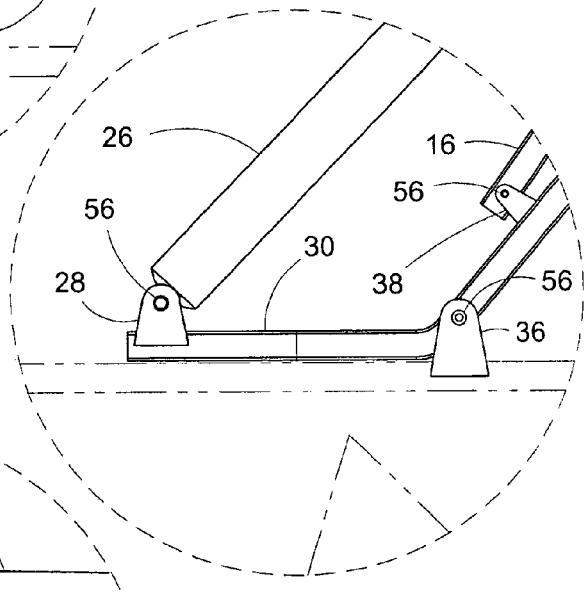
FIG. 11 is a partial expanded side view showing the engagement of the front and rear bars, the mounting of the front actuator to the rear bar and the pivotal mounting of the rear bar to the side rail of an illustrative pontoon boat when the top is in the RADAR position.

FIG. 11 is a 10× partial side view of the same area when Automatic Bimini Top 15 is in the RADAR position. In this RADAR position, rear actuator rod 46 is still extended and the bottom of the foot of rear bar 30 is still in contact with the top of the side rail of typical pontoon boat 40.

Figure 12:
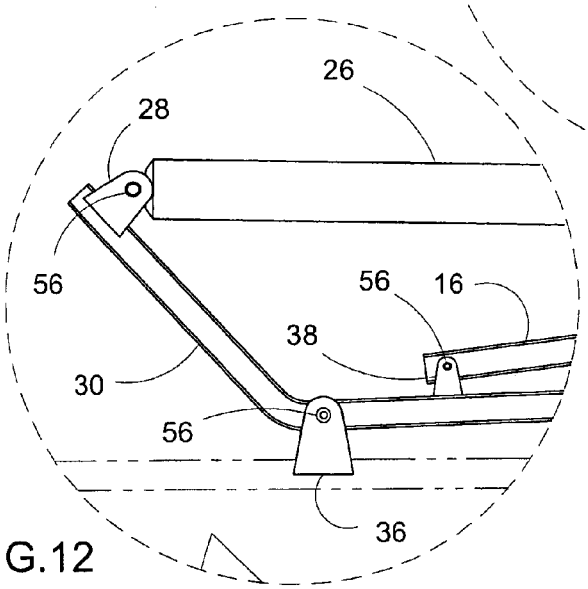
FIG. 12 is a partial expanded side view showing the engagement of the front and rear bars, the mounting of the front actuator to the rear bar and the mounting of the rear bar to the side rail of a pontoon boat when the top is in the DOWN position.

FIG. 12 is a 10× partial side view of the same area when Automatic Bimini Top 15 is in the DOWN or parallel to the deck position. Rear actuator 48 has now retracted rear actuator rod 46, causing rear bar 30 to rock back around rear bar bottom pivot 36 allowing Automatic Bimini Top 15 to be completely lowered for passing under low bridges or stowed for trailer travel.

Figure 13:
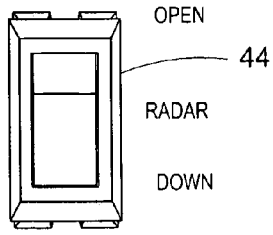
FIG. 13 is a top view showing a three position toggle switch.

FIG. 13 shows a typical three position (OPEN, RADAR and DOWN) rocker switch which can be mounted in any convenient location.

When a boater travels his boat 40, typically the top frame is collapsed down and is parallel to the deck and the folded top 42 is wrapped or contained in a travel case or boot 58. When a boat with the Automatic Bimini Top 15 is unloaded into the water, switch 44 is toggled from the DOWN position to the RADAR position. This causes rear actuators 48 located on both sides of the boat to extend their rear actuator rods 46 upward pivoting the whole frame assembly upwards to the RADAR position, approximately sixty degrees about the rear bar bottom pivots 36 which are attached to the side rails of the boat. The ends of rear bar 30 are bent upward at approximately sixty degrees and are pivotally mounted to the side rails above the sixty degree bends at rear bar bottom pivot 36. The forward extensions from pivot 36 are forced to lay parallel and coincident with the top of the side rails and act as a stop when the frame is rotated up to its RADAR position. If top 42 is required to be raised to its OPEN position for shade or protection from inclement weather, boot 58 is removed from folded top 42. Switch 44 is toggled to the OPEN position causing front actuators 26 mounted on both ends of rear bar 30 to retract, pulling front bar 16 pivotally forward, allowing fabric pockets in top 42 encasing the tops of short front bar 22, short rear bar 32, front bar 16 and rear bar 30 or other standard attachment means to pull short bars 22 and 32 away from the front bar 16 and rear bar 30 respectively, creating a four bar support under a typical Bimini top 42.

When top 42 is to be returned to the RADAR position for optimum running, switch 44 is toggled back to the RADAR position which causes front actuators 26 to extend their actuator rods 34, rotating front bar 16 backward. The short bars collapse parallel to each other with the aid of torsion assist springs 24. When boat 40 is again to be trailered or if boat 42 needs to go under a low clearance bridge, switch 44 is toggled to the DOWN position and rear actuators rods 46 are both retracted, pivoting the whole frame assembly back to parallel with the deck.

The preceding descriptions are for illustrative purposes and are not intended to limit the scope of this invention. One skilled in these fabrication arts will see many options for materials, driver systems, springs and controls combinations that fit within the scope of this invention. The scope of the invention should be determined by the appended claims rather than by the specific examples given.

The invention claimed is:

1. A Bimini top frame assembly for a watercraft with automatic lift mechanisms that raise said top frame assembly from a DOWN position, parallel to a deck, to a RADAR position, angled upward and aft at approximately a sixty degree angle, to an OPEN and fully extended position and lower said top frame assembly back to previous positions comprising:

a rear bar that is u-shaped whereby the u is as wide as said watercraft and tall enough to provide walk-under clearance when it is pushed up to said RADAR or OPEN positions and is formed from aluminum tubing with a front side and a rear side with bends up at approximately sixty degrees from the plane of said front side, approximately 8 inches back from both ends, pivotally attached to side rails of said watercraft just above said bends and fastened at the top to the rear edge of a Bimini top;

a front bar that is u-shaped whereby the u is as wide as said watercraft and tall enough to provide walk-under clearance when it is pulled to said OPEN position and is formed from aluminum tubing with a front side and a rear side, pivotally attached to said rear bar above said pivotal attachments of said rear bar to said craft side rails and attached to the front edge of said top;

a front short bar that is u-shaped whereby the u is as wide as said watercraft and is formed from aluminum tubing, being pivotally attached on both sides to said rear side of said front bar and fastened to a front center section of said Bimini top such that it supports the front center section of said Bimini top when pulled open by said attachment to said top;

a rear short bar that is u-shaped whereby the u is as wide as said watercraft and is formed from aluminum tubing, being pivotally attached on both sides to said front side of said rear bar and fastened to a rear center section of said Bimini top to support the rear center section of said Bimini top when pulled open by said attachment to said top;

four springs mounted at the pivots between said front bar and front short bar and said rear short bar and rear bar, assist in collapsing said short bars parallel to said long bars when said top is moved from the fully Open to the Radar position;

two rear lift mechanisms comprised of actuator rods and actuators where the distal ends of said actuators are pivotally mounted to said side rails of said watercraft and the proximal ends of said actuators are allowed to swing freely as said actuator rods are extended out from said actuators with the distal ends of said actuator rod pivotally attached to said rear side of said rear bar on each side of said rear bar, raising said frame assembly from said DOWN position to said RADAR position and returning said frame assembly to said DOWN position when said actuator rods are retracted into said actuators;

two front lift mechanisms comprised of actuator rods and actuators where the proximal ends of said actuators are pivotally attached to the bottom ends of said rear bar and the distal ends of said actuator rods are pivotally attached to said front side of said front bar whereby when said actuator rods are retracted into said actuators, said top is lifted from said RADAR position to said OPEN position and when distal end of said actuator rod is fully extended, it pivots said front bar back down into said RADAR position.

2. A Bimini top frame assembly for a watercraft with automatic lift mechanisms that raise and lower said top frame as in claim 1 wherein said lift mechanisms are selected a group of pneumatic, hydraulic or electromechanical systems.

3. A Bimini top frame assembly for a watercraft with automatic lift mechanisms that raise and lower said top frame as in claim 1 whereby operation of said lift mechanisms is controlled by a switch or network of switches comprised of a plurality of two-way or three-way switches with positions OPEN, RADAR and DOWN: when said switch is in said DOWN position and said Bimini top frame assembly is in its parallel to the deck, collapsed DOWN position and said switch is toggled to said RADAR position, said rear lift mechanisms extend to their full length, pivoting said Bimini top frame assembly, still in a folded aspect, to said RADAR position;

when said switch is toggled again to said OPEN position, said front lift mechanisms retract, pulling said collapsed Bimini top frame assembly open to said OPEN position, allowing said top to pull said short bars open, putting said torsion springs in tension;

when said switch is toggled back to said RADAR position, said front lift mechanisms extend, driving said front edge of said Bimini top frame assembly pivotally, allowing said springs to assist in collapsing said short bars approximately parallel to said front bar and said rear bar, folding said Bimini top frame assembly back to said RADAR position; and when said switch is toggled back to said DOWN position, said rear lift mechanism fully retracts, causing said collapsed Bimini top frame assembly to pivot back to said DOWN, parallel to deck, position.

4. A Bimini top frame assembly for a watercraft with automatic lift mechanisms that raise and lower said top frame as in claim 1 whereby said spring assists are chosen from a group of torsion springs, compression springs and air or gas springs.

5. A Bimini top frame assembly for a watercraft with automatic lift mechanisms that raise and lower said top frame as in claim 1 whereby pivotal connections are comprised of unshaped aluminum brackets mounted to said watercraft side rails and to said front and rear bars whereby the u is wide enough to allow said aluminum tubes and distal ends of actuator rods and distal and proximal ends of actuators to slip fit between standing side walls of said brackets which have transverse matching holes aligned with through holes in said aluminum and distal ends of actuator rod and distal and proximal ends of actuators into which a pivot pin is inserted.

* * * * *